US005098320A

United States Patent [19]

Colleran et al.

[11] Patent Number: 5,098,320

[45] Date of Patent: Mar. 24, 1992

[54] SHROUDED ELECTRICAL CONNECTOR

[75] Inventors: Stephen A. Colleran, Lisle; Lawrence E. Geib, Bartlett; Fred L. Krehbiel, Chicago, all of Ill.

[73] Assignee: Molex Incorporated, Lisle, Ill.

[21] Appl. No.: 619,576

[22] Filed: Nov. 29, 1990

[51] Int. Cl.[5] ..... H01R 4/02

[52] U.S. Cl. ..... 439/876; 439/884

[58] Field of Search ..... 439/851, 853, 876, 884, 439/284, 290

[56] References Cited

U.S. PATENT DOCUMENTS 3,188,600 6/1965 Woofter et al. ..... 439/290

3,972,580 8/1976 Pemberton et al. ..... 439/290

*Primary Examiner*—Eugene F. Desmond

*Attorney, Agent, or Firm*—A. A. Tirva; Stephen Z. Weiss

[57] ABSTRACT

A male terminal is provided with a male contact portion and a shroud portion disposed about the male contact portion. The male contact portion is integral with and folded into the interior of the shroud portion whereby the shroud portion protects the male contact portion. An electrical connector assembly includes a female connector having a housing which includes channels for receiving the shroud portion of the male terminal, and a female terminal in the housing mates with the male contact portion of the male terminal when the shroud is received in the channels of the housing.

24 Claims, 2 Drawing Sheets

SHROUDED ELECTRICAL CONNECTOR

FIELD OF THE INVENTION

This invention generally relates to the art of electrical connectors and, particularly, to a male terminal which has an integral shroud for protecting a male contact.

BACKGROUND OF THE INVENTION

There are many fields in which electrical connectors or the components thereof are subject to damage during shipping and handling. In many instances, the connector or connector components cannot remain protected by their original packaging and must be shipped separately unmounted from a device or apparatus with which the component is electrically associated. One such field is the automotive field wherein considerable handling is involved because of the nature of mass producing/assembly line manufacturing of automobiles and the many different suppliers of parts therefor.

One example is in manufacturing windows having conductors imbedded therein for defogging purposes. The windows are fabricated separately and then assembled to the final product. However, connectors are used to couple the window conductor to some form of electrical wiring harness on the automobile. It would be desirable to have an electrical connector component already attached or coupled to the window and shipped in that condition so that the window simply is assembled to the automobile and readily coupled in-circuit with the separately assembled wiring harness. However, such an electrical connector component will be exposed during manufacture, shipping and handling and is prone to be damaged during such movement.

This invention is directed to solving the problems outlined above by providing a male terminal for an electrical connector assembly which is very easy and inexpensive to manufacture and which has an integral shroud for protecting the male contact portion of the terminal.

SUMMARY OF THE INVENTION

An object, therefore, of the invention is to provide a new and improved male terminal having integral protection for a male contact portion thereof.

Another object of the invention is to provide an electrical connector assembly which includes the male terminal of the invention and a complementary electrical connector which has a female terminal and a housing for receiving the novel male terminal.

Generally, the invention contemplates providing a male terminal having a male contact portion and a shroud portion about the male contact portion. The male contact portion is integral with and folded into the interior of the shroud portion whereby the shroud portion protects the male contact portion.

More particularly, the male terminal is fabricated as a one-piece structure of stamped and formed metal. The shroud portion is generally hollow with opposite ends. The male contact portion is folded inwardly from one end of the hollow shroud portion. The male contact portion also is folded onto itself to form a double thickness therefor. As disclosed herein, the shroud portion is generally rectangularly shaped in cross-section.

The shroud portion of the male terminal has terminating means on the outside thereof for coupling the terminal in an appropriate circuit. In the example described in the Background, above, the terminating means is shown herein as a solder pad for soldering to a complementary solder pad on the surface of a glass window. The terminal can be appropriately terminated to a defogging conductor imbedded in the window glass. By the construction described above, the male contact portion of the terminal is protected by the integral surrounding shroud portion during manufacture, shipping, handling and assembly of the window part of an automobile. Once assembled, the male terminal is readily connectable to a female terminal of a connector on an already assembled harness of the automobile.

The invention also contemplates providing an electrical connector assembly which includes a female connector having a housing with a female terminal. The female terminal mates with the male contact portion of the male terminal, and the housing has channel means for receiving the shroud portion of the male terminal surrounding the male contact portion.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
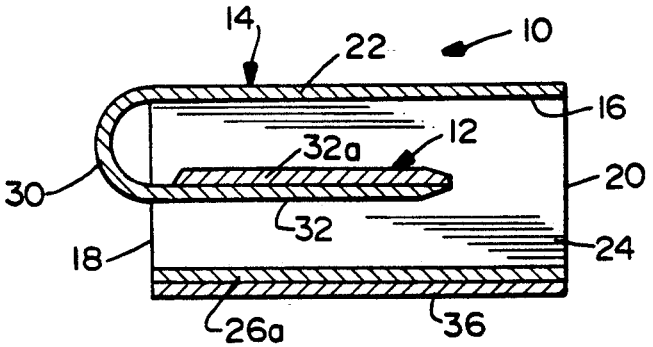
FIG. 1 is a longitudinal section through the male terminal of the invention, generally along the line 1—1 of FIG. 3.
Figure 3:
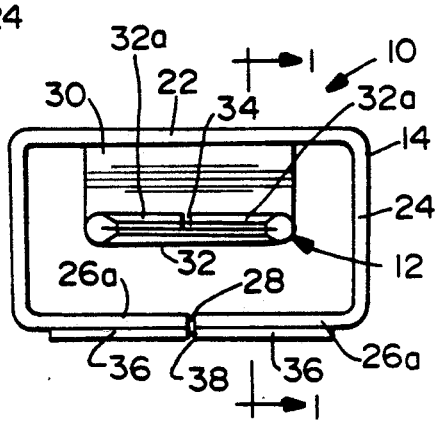
FIG. 3 is an end elevational view of the male terminal, looking toward the right-hand end of FIG. 1.
Figure 2:
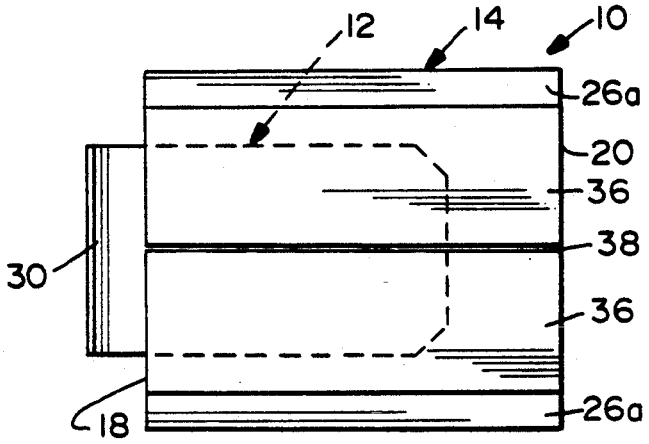
FIG. 2 is a bottom plan view of the male terminal of FIG. 1.

Referring to the drawings in greater detail, and first to FIGS. 1-3, the invention contemplates providing a male terminal, generally designated 10, which includes a male contact portion, generally designated 12, and a shroud portion, generally designated 14, about male contact 12. Male terminal 10 is fabricated as a one-piece structure of stamped and formed metal material.

More particularly, shroud 14 of male terminal 10 is tubular in shape to define a hollow interior 16 and opposite open ends 18 and 20. The shroud is generally rectangularly shaped in cross-section as seen in FIG. 3 and as defined by a top wall 22, opposite side walls 24 and bottom wall portions **26*a* which meet at a split line 28. The shroud is easily formed from a stamped metal blank by folding the metal into the rectangular configuration, with opposite side edges of the blank meeting at split line 28**.

Male contact 12 is formed from the metal blank prior to folding the shroud thereabout. In particular, the male contact forms an extension of top wall 22 of the shroud, as best seen in FIG. 1, and is folded, as at 30, back under the top wall so as to be generally centrally disposed within the hollow interior 16 of the shroud. As seen best in FIGS. 1 and 3, male contact 12 is in the form of a flat blade 32 which has a double thickness provided by folding side portions 32a back over the top of blade 32 whereby they substantially meet at a split line 34 (FIG. 3).

From the foregoing, it can be seen that male contact 12 is substantially entirely surrounded by shroud 14 and is protected by the shroud during shipping, handling, or assembly.

As will be understood in greater detail hereinafter, male terminal 10 includes terminating means thereon for coupling the terminal in an appropriate circuit. For the particular application described herein for use in terminating a conductor in a defogging window for an automobile, the terminating means are provided in the form of a bifurcated solder pad 36 pre-attached to the bottom wall portions 26a of shroud 14 prior to the stamping and forming fabrication operation. The pad is attached to the bottom wall of the shroud, the solder pad including a split line 38 (FIG. 3) aligned with split line 28 in the bottom wall of the shroud.

Figure 4:
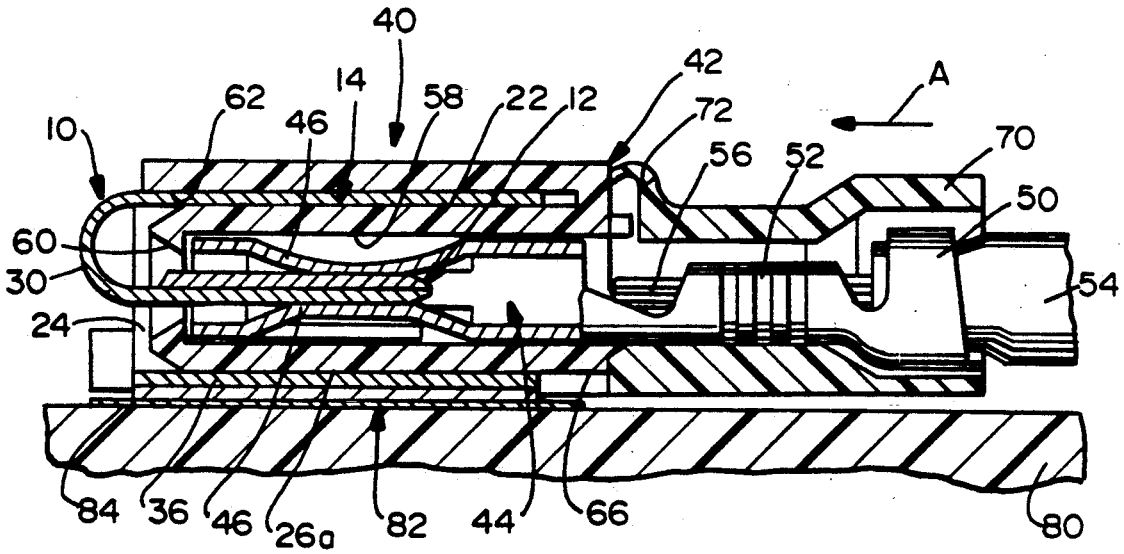
FIG. 4 is a longitudinal section through a connector assembly including the male terminal.
Figure 5:
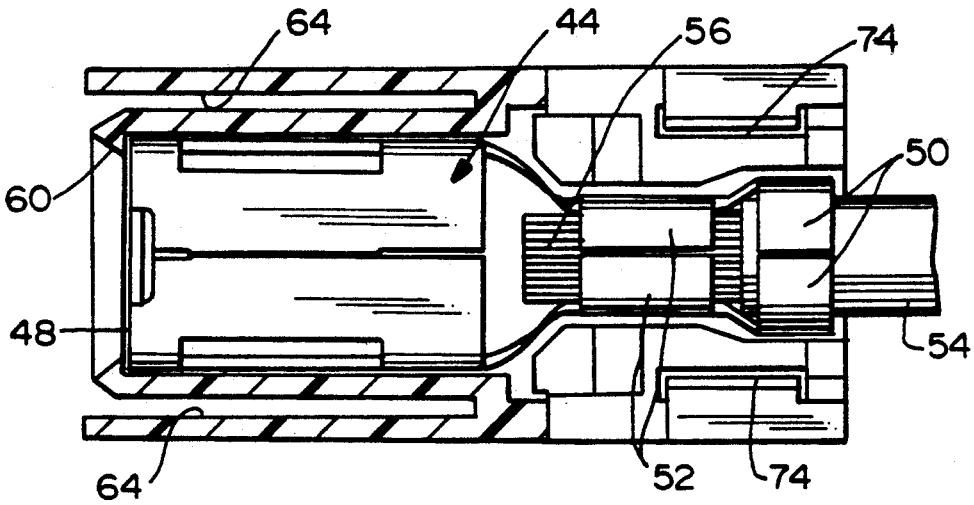
FIG. 5 is a section taken generally along a horizontal line through FIG. 4, with the male terminal removed to facilitate the illustration.

Referring to FIGS. 4 and 5, the invention contemplates providing an electrical connector assembly, generally designated 40 (FIG. 4) which includes a female connector, generally designated 42, for meeting with male terminal 10.

In particular, female connector 42 includes a housing mounting a female terminal, generally designated 44, therewithin.

Figure 6:
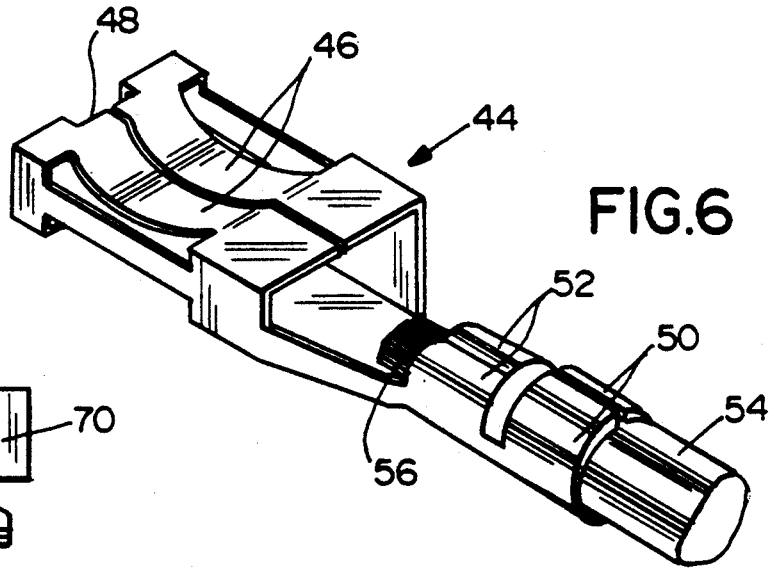
FIG. 6 is a perspective view of the female terminal of the connector assembly shown in FIGS. 4 and 5.

Referring to FIG. 6, female terminal 44 includes a female receptacle portion having inwardly directed spring arms 46 on opposite sides of a receptacle area 48. The female terminal includes two pairs of crimp arms 50 and 52. Crimp arms 50 are crimped onto an electrical wire 54, and crimp arms 52 are crimped onto exposed conductors 56 of the wire.

Referring back to FIG. 4, spring arms 46 are located within an interior cavity 58 of the female connector housing. Male contact 12 of male terminal 10 is insertable through a mouth 60 of the housing, into cavity 58 and into engagement with spring arms 48 of female terminal 44 for mating therewith and establishing an electrical connection therethrough.

The housing of female connector 42 also includes channel means for receiving shroud 14 of male terminal 10. The channel means is generally rectangularly shaped for receiving the walls of the rectangularly shaped shroud. In particular, the channel means includes a top channel 62 (FIG. 4) for receiving top wall 22 of the shroud, side channels 64 (FIG. 5) for receiving side walls 24 of the shroud and an open or recessed area 66 (FIG. 4) at the bottom of the housing for receiving bottom wall 26a of the shroud.

Therefore, female connector 42 is mated with male terminal 10 in the direction of arrow "A" (FIG. 4) whereby male contact 12 moves into female contact 44 between spring arms 46, and the walls 22, 24 and 26a move into channels or recesses 62, 64 and 66, respectively, of the female connector housing.

Figure 7:
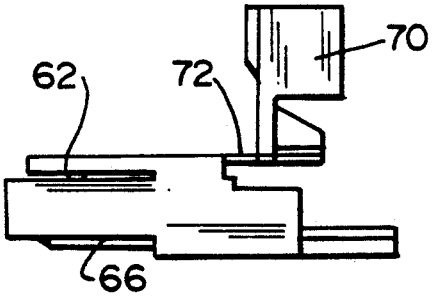
FIG. 7 is an elevational view, on a reduced scale, of the housing of the female connector, with a hinged portion thereof in a terminal loading position.
Figure 8:
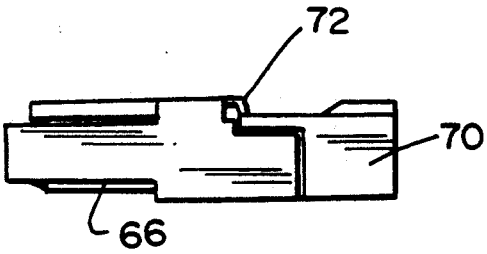
FIG. 8 is a view similar to that of FIG. 7 with the hinged portion in a closed locked position.

FIGS. 7 and 8 simply show that female connector 42 includes a housing portion 70 joined to the remainder of the connector housing by a living hinge 72 whereby the housing portion is movable between an open or terminal loading position shown in FIG. 7 to allow loading of the female terminal 44 into the female connector, and a closed or locked position shown in FIG. 8 to surround the crimped areas of the female terminal. Snap latch flanges 74 (FIG. 5) lock the housing portion in its closed position. The entire housing of female connector 42, including hinged portion 70, is unitarily fabricated of molded material, such as plastic or the like.

As stated above, terminating means in the form of a split solder pad 36 is provided on the outside of shroud 14 of male terminal 10, particularly attached to the bottom wall 26a of the terminal. With recessed area 66 (FIG. 4) of female connector 42 being open at the bottom of the connector, solder pad 36 is exposed at the bottom of the connector assembly. Item 80 in FIG. 4 represents a glass panel, such the rear window of an automobile. The window includes conductors, one of which is shown at 82, providing defogging means for the window. A solder pad 84 is attached to the surface of the glass, as by an appropriate adhesive, and is electrically coupled to conductor 82. Solder pad 36 on the bottom of male terminal 10 is soldered to solder pad 84 on the window, thereby to electrically couple the male terminal to the defogging conductor(s) imbedded within the window glass. Female connector 42, including female terminal 44, would comprise a termination with an electrical harness of the automobile whereby defogging conductor(s) 82 can be electrically coupled through male terminal 10 to the electrical power source of the automobile. It also might be pointed out that the solder pad increases the strength of shroud 14 when soldered to solder pad 84 on the rigid window glass. With male contact 12 being substantially surrounded by the shroud, the male contact is completely protected when the male terminal is fixed to the glass panel. It can be seen that the configuration of the male terminal provides a low profile, and the shroud acts as a heat sink in high amperage conditions.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A male terminal, comprising:

a male contact portion;

a shroud portion about the male contact portion; and wherein the male contact portion is integral with an folded into the interior of the shroud portion whereby the shroud portion substantially surrounds and protects the male contact portion; and wherein said shroud portion is generally hollow with opposite open ends, and the male contact portion is folded inwardly from one end of the shroud portion.

2. The male terminal of claim 1 wherein the terminal comprises a one-piece structure.

3. The male terminal of claim 2 wherein the terminal is fabricated of stamped and formed metal.

4. The male terminal of claim 1 wherein said male contact portion is folded onto itself to form a double thickness therefor.

5. The male terminal of claim 1 wherein said shroud portion is generally rectangularly shaped in cross-section.

6. The male terminal of claim 1 wherein said shroud portion has terminating means thereon for coupling the terminal in an appropriate circuit.

7. The male terminal of claim 6 wherein said terminating means are disposed on the outside of the shroud portion.

8. The male terminal of claim 7 wherein said terminating means comprise a solder pad.

9. A male terminal, comprising:

a male contact portion folded onto itself to form a double thickness therefor;

a shroud portion substantially surrounding the male contact portion; and wherein the male terminal comprises a one-piece construction of stamped and formed metal, and the male contact portion is integral with and folded into the interior of the shroud portion whereby the shroud portion protects the male contact portion.

10. The male terminal of claim 9 wherein said shroud portion is generally hollow with opposite open ends, and the male contact portion is folded inwardly from one ned of the shroud portion.

11. The male terminal of claim 10 wherein said shroud portion is generally rectangularly shaped in cross-section.

12. The male terminal of claim 9 wherein said shroud portion has terminating means thereon for coupling the terminal in an appropriate circuit.

13. The male terminal of claim 12 wherein said terminating means are disposed on the outside of the shroud portion.

14. The male terminal of claim 13 wherein said terminating means comprise a solder pad.

15. An electrical connector assembly, comprising:

a male terminal including a male contact portion, a shroud portion about the male contact portion, and wherein the male contact portion is integral with and folded into the interior of the shroud portion whereby the shroud portion protects the male contact portion; and a female connector including a housing having channel means for receiving the shroud portion of the male terminal, and a female terminal on the housing for mating with the male contact portion of the male terminal when the shroud is received in said channel means.

16. The electrical connector assembly of claim 15 wherein said housing has an interior cavity receiving and positioning the female terminal, and said channel means are disposed about the interior cavity.

17. The electrical connector assembly of claim 16 wherein the shroud portion of said male terminal substantially surrounds the male contact portion, and the channel means of said housing substantially surrounds the interior cavity.

18. The electrical connector assembly of claim 17 wherein said shroud portion is generally hollow with opposite open ends, the male contact portion is folded inwardly from one end of the shroud portion, and the other end of the shroud portion is positionable in said channel means.

19. The electrical connector assembly of claim 15 wherein said male terminal comprises a one-piece structure of stamped and formed metal.

20. The electrical connector assembly of claim 15 wherein said male contact portion is folded onto itself to form a double thickness therefor.

21. The electrical connector assembly of claim 15 wherein said shroud portion of the male terminal is generally rectangularly shaped in cross-section, and the channel means of said housing are complementarily rectangularly shaped for receiving the rectangularly shaped shroud portion.

22. The electrical connector assembly of claim 15 wherein said shroud portion has terminating means thereon for coupling the terminal in an appropriate circuit.

23. The electrical connector assembly of claim 22 wherein said terminating means are disposed on the outside of the shroud portion of the male terminal, and a portion of the channel means of the housing is open to expose the terminating means on the outside of the electrical connector assembly.

24. The electrical connector assembly of claim 23 wherein said terminating means comprise a solder pad.

* * * * *